United States Patent [19]

Hnojsky

[11] 4,068,646

[45] Jan. 17, 1978

[54] CRANK CASE OIL PAN

[76] Inventor: Joseph F. Hnojsky, 2249 S. 18th Ave., North Riverside, Ill. 60546

[21] Appl. No.: 613,482

[22] Filed: Sept. 15, 1975

[51] Int. Cl.[2] ..... F16N 31/00

[52] U.S. Cl. ..... 123/195 C; 180/69.1; 184/6.5; 184/106; 220/4 F

[58] Field of Search ..... 220/5 A, 4 F; 123/196 R, 195 C, DIG. 6, DIG. 7; 184/6.5, 106; 180/69.1

[56] References Cited

U.S. PATENT DOCUMENTS

| | | | |
|---|---|---|---|
| 2,577,188 | 12/1951 | Hall | 184/106 |
| 2,618,351 | 11/1952 | Giacosa | 123/196 R X |
| 2,837,063 | 6/1958 | Martinez | 123/195 C X |
| 3,561,416 | 2/1971 | Kiekhaefer | 123/DIG. 7 |
| 3,724,599 | 4/1973 | Heidacker | 123/195 C X |

*Primary Examiner*—Charles J. Myhre
*Assistant Examiner*—Ira S. Lazarus

[57] ABSTRACT

An oil pan designed for installation underneath a crank case of an internal combustion engine, the oil pan of the present invention consisting of two separate sections each of which is secured independently to the engine as well as to each other so that either one can be selectively removed while the other is left on so to eliminate the labor of removing the entire oil pan.

1 Claim, 5 Drawing Figures

CRANK CASE OIL PAN

This invention relates generally to internal combustion engines, and more particularly to a crank case oil pan.

A principal object of the present invention is to provide an oil pan which is composed of two or more sections instead of being made all in one piece.

Another object of the present invention is to provide a crank case oil pan which by being made in two or more sections eliminates the heretofore necessity of raising the vehicle's engine to remove an entire oil pan, thus saving on time and labor.

Yet a further object of the present invention is to provide an oil pan of the type described which will have overlapping edges of the sections or else abutting edges so that they can be secured together by suitable fasteners so to have the same utility as a conventional one-piece oil pan.

Other objects are to provide a crank case oil pan which is simple in design, inexpensive to manufacture, rugged in construction, easy to use and efficient in operation.

These and other objects will be readily evident upon a study of the following specification and the accompanying drawing, wherein.

Figure 1:
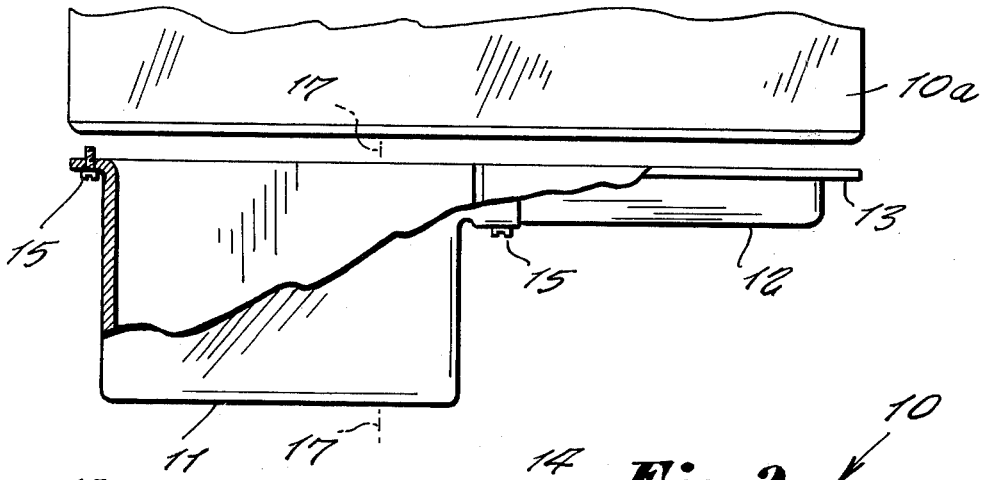
FIG. 1 is a side elevation view of the present invention shown partly broken away and dismounted from the engine block.
Figure 2:
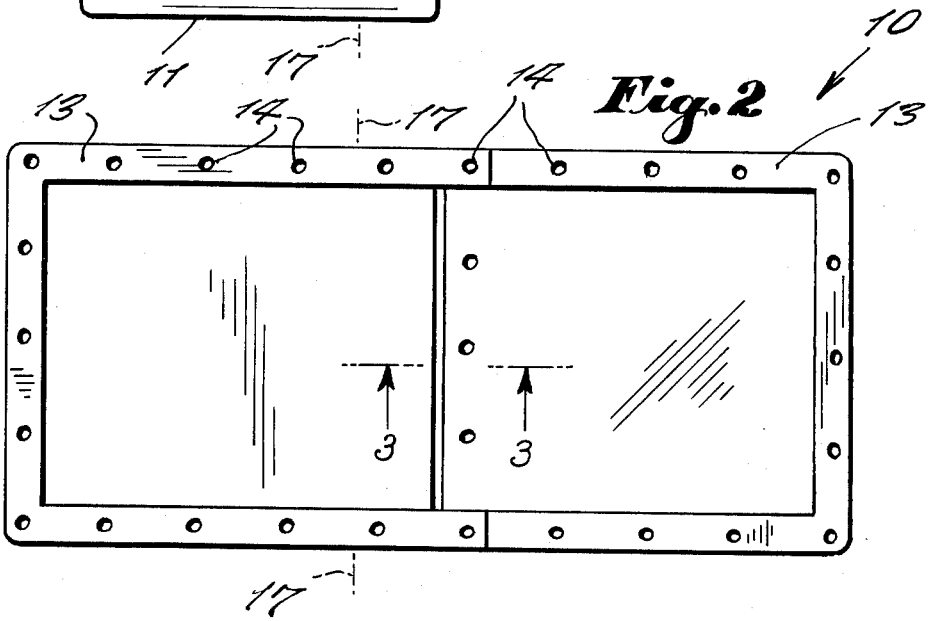
FIG. 2 is a top plan view of the present invention shown per se.
Figure 3:
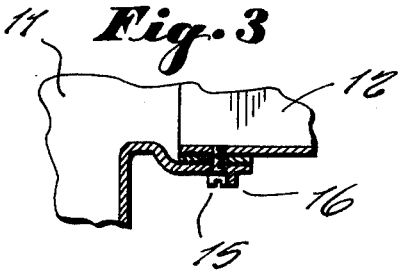
FIG. 3 is an enlarged cross sectional view taken on line 3—3 of FIG. 2, and showing one form of securement of the oil pan sections together.

Referring now to the drawing in detail, and more particularly to FIGS. 1 to 3 thereof, at this time, the reference numeral 10 represents a crank case oil pan according to the present invention, and which includes a hollow oil pan section 11 which mates and engages a second oil pan section 12, each of the sections 11 and 12 having a mating flange 13 with spaced apart openings 14 for receiving suitable fasteners 15 in order that the sections thus together form a unitary oil pan 10 for installation underneath an engine block 10*a*.

As shown more clearly in FIG. 3 of the drawing, a gasket 16 is secured between the overlapping edges of sections 11 and 12 so as to provide an effective seal when the oil pan is installed under the engine block. Referring now more particularly to FIG. 1 of the drawing, it will be noted that a modified separation point for the sections 11 and 12 may be provided along the plane of the dot-dash line 17 so to be through the deeper oil pan section 11 rather than through the shallow oil pan section 12, and which may be preferred as a joining point for certain design of automotive engines.

Figure 4:
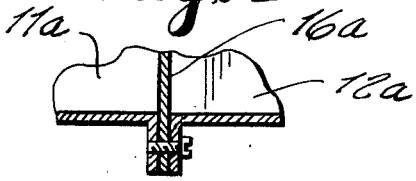
FIG. 4 is a view similar to FIG. 3 and showing a modified design of joining the two oil pan sections together.

Referring now to FIG. 4 of the drawing, a modified design of joint between the oil pan sections 11*a* and section 12*a* consists of abutting flanges formed on each section and a gasket 16*a* being located therebetween. This form of the invention may possibly be more easily for the automobile mechanic to remove either one of the sections because neither section fits inside each other.

Figure 5:
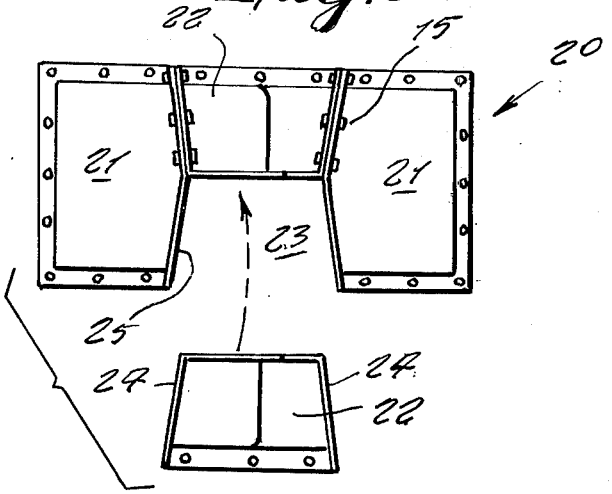
FIG. 5 is a bottom view of a modified design of the invention wherein the oil pan is comprised of more than two sections.

Reference is now made to FIG. 5 of the drawing, wherein there is shown a modified design of crank case oil pan 20 which differs from the crank case oil pan 10 by being made up of more than only two sections. The oil pan 20 as shown includes opposite end sections 21 with intermediate sections 22 therebetween. This form of the invention preferrably employs the flange type construction as is shown in FIG. 4 in order that the intermediate sections 22 can be readily removed alone in case the end sections 21 are preferred to not be removed. Also it is to be noted that each of the intermediate sections 22 are of wedge shape so that they will readily slip out from the space 23 after the fasteners 15 are removed, thus not requiring the same to be forcibly hammered out such as would be necessary in case the opposite side edges 24 thereof were parallel to each other. Each of the end sections 21 has an abutting edge 25 which accordingly is V-shaped when view from a bottom as indicated in FIG. 5 so to accommodate the converging sides 24 of the wedge-shaped intermediate sections 22.

Thus a modified design of the invention is provided.

While various changes may be made in the detail construction, it is understood that such changes will be within the spirit and scope of the present invention as is defined by the appended claims.

What I claim is:

1. An improved crank case oil pan, comprising in combination, a plurality of six interfitting sections, and including an end section at each end and a pair of wedge-shaped sections therebetween, each said section including a flange having openings therethrough for receiving mounting bolts to fasten said sections to an underside of an engine block, said bolts extending through a gasket fitted between said engine block and said oil pan, one end of said oil pan being downwardly relatively deep while an opposite end thereof is downwardly shallow, a vertical wall forming a shoulder between said deep and said shallow ends, said vertical wall extending across said wedge-shaped sections, each said section additionally including an outwardly turned flange along all edges that abut with mating-like flanges of an adjacent said section, bolt openings through said flanges receiving mounting bolts for securing said sections together, and said sections each being independently removable from said engine block without need of removal of adjacent said sections.

* * * * *